US012379181B2

(12) United States Patent
Braden

(10) Patent No.: US 12,379,181 B2
(45) Date of Patent: Aug. 5, 2025

(54) COUNTERCLOCKWISE TWISTED FIBER MATERIAL TWISTED TOGETHER IN COUNTERCLOCKWISE DIRECTION TO FORM A BOW STRING AND/OR CABLE

(71) Applicant: Michael R. Braden, North Richland Hills, TX (US)

(72) Inventor: Michael R. Braden, North Richland Hills, TX (US)

( * ) Notice: Subject to any disclaimer, the term of this patent is extended or adjusted under 35 U.S.C. 154(b) by 97 days.

(21) Appl. No.: 18/131,973

(22) Filed: Apr. 7, 2023

(65) Prior Publication Data

US 2024/0337461 A1 Oct. 10, 2024

(51) Int. Cl.
*F41B 5/14* (2006.01)
*D07B 5/00* (2006.01)
*F41B 5/10* (2006.01)

(52) U.S. Cl.
CPC ..... *F41B 5/1411* (2013.01); *D07B 5/00* (2013.01); *D07B 2201/1048* (2013.01); *D07B 2201/1068* (2013.01); *D07B 2201/2024* (2013.01); *D07B 2501/20* (2013.01); *F41B 5/105* (2013.01)

(58) Field of Classification Search
CPC ..... F41B 5/1411; F41B 5/105; D02G 3/444; D07B 2201/1048; D07B 2201/1068; D07B 2201/2024; D07B 5/00
See application file for complete search history.

(56) References Cited

U.S. PATENT DOCUMENTS

| | | | | |
|---|---|---|---|---|
| 2,133,071 | A * | 10/1938 | Anderson | D07B 1/02 57/309 |
| 4,168,606 | A * | 9/1979 | Callander | D02G 3/444 57/236 |
| 5,598,831 | A * | 2/1997 | Izuta | F41B 5/1411 124/90 |
| 5,676,123 | A * | 10/1997 | McPherson | F41B 5/1419 124/90 |
| 5,752,496 | A | 5/1998 | McPherson | |
| 10,126,090 | B1 | 11/2018 | Abernethy | |
| 2012/0152219 | A1* | 6/2012 | McPherson | F41B 5/1411 124/90 |
| 2014/0261366 | A1* | 9/2014 | McPherson | F41B 5/14 124/90 |
| 2016/0025444 | A1* | 1/2016 | Griggs | F41B 5/1411 124/90 |

* cited by examiner

*Primary Examiner* — John E Simms, Jr.

(57) ABSTRACT

A string such as a bowstring or cable used in archery bows and crossbows include multiple strands. The multiple strands are not bound to each other but remain parallel and positioned side-by-side. The desired number of strands are laid up to a determined length and grouped together to create a bundle. The bundles can have different properties such as strength and stability depending on the direction the strands and bundles are twisted.

9 Claims, 6 Drawing Sheets

COUNTERCLOCKWISE TWISTED FIBER MATERIAL TWISTED TOGETHER IN COUNTERCLOCKWISE DIRECTION TO FORM A BOW STRING AND/OR CABLE

BACKGROUND/SUMMARY

Technical Field

The present disclosure generally relates to string and cables for archery bows and more specifically to an improved bow string designed to minimize what's known in the archery industry as creep, stretch, or rather the elongation of the string or cables desired length. As the string and cables maintain a more consistent length, the bow is able to stay within a manufacturer's published specifications with regards to the bow's axle to axle length, brace height, static cam timing, and the synchronization of the cams, as well as maintain a consistent draw length, poundage, and tune of the bow. The improved bowstring and cables also will improve accuracy as the direction the string bundle is twisted will generate a preferred cast or rotational direction in an arrow as it is propelled by the string when shot away from the bow.

Background

Bows without cams, such as a traditional bow, recurve bow, or crossbow, may have a single bowstring connecting the limbs to hold tension in their limbs and to shoot arrows and bolts. Compound bows and crossbows have cams that typically have one long bowstring with at least one cable that wraps around the cams and is used to store energy and shoot the arrow.

Bowstrings serve an important role in the shooting of a bow. However sometimes, bowstrings break before their life expectancy. Other times, the fibers within the bowstrings lose their integrity and strength resulting in an elongation of the strings overall length, also known as "creep," that hinders shooting performance. Additionally, the constant use of a bow string with high tensile loads and repeated load cycles tend to elongate the strings over time, thereby decreasing the stability, strength, and the overall length of the strings. Environmental conditions (e.g., temperature and humidity) can also increase the elongation of the strings. As a result, the accuracy and efficiency of the bow or crossbow can deteriorate over time. For these and other reasons, archers and other sportsmen constantly seek improvements to bowstrings and cables used in archery equipment.

Materials used for strings in bows have evolved over time from sinew and horsehair to steel cabling, to current thermoplastic fibers and other modern materials bundled together. The fiber material used in the manufacturing of the bowstrings of bows and crossbows experience challenges that are not experienced by fibers in other fields. Therefore, a bowstring is generally formed through a manufacturing tensioning process. In the manufacturing tensioning process, the manufacturer tensions a plurality of individual strands, each strand including a plurality of fibers, to a predetermined manufacturing tension (e.g. 300-600 lbs of force). While under the predetermined manufacturing tension, the plurality of individual strands may then be twisted.

Currently, the only fiber material available for purchased, is a fiber that is manufactured with a clockwise twist. With almost all of these materials, the string is formed when multiple fiber strands are stacked together in a parallel manner, and are then twisted to form unity of a bundle or rope-like cords having the length and shape needed for the strings. Each fiber strand typically has similar material construction.

Alternatively, those in the art have created separate bundles where one group has strands twisted in a counterclockwise direction and entwined into a bundle, while a second group of strands are twisted in a clockwise direction and entwined into a bundle. The two bundles then are twisted together in a clockwise direction to form a completed bow string. A problem exists with the prior art bow strings based on the clockwise twist of the fiber strand material and with the counterclockwise twist of the entwined bundles.

Another important effect that the bow string has on another piece of the archer's equipment, is that the direction the string bundle is twisted will cause an arrow to cast or rotate a certain direction as it is propelled by the string during the shot. The result of a traditionally clockwise twisted fiber, stacked together in a clockwise twisted bundle will cause an arrow to cast counterclockwise or left, as it leaves the string when shot from a bow.

Yet, over many decades of archers, those of skill in the art generally fletched their arrow shafts with either feathers or vanes having a right "helical" or "offset" twist direction in the fletchings. This creates a change in the direction of rotation in the arrow from the initiated launch direction of left or counter clockwise created by the clockwise twist in the string, to a right or clockwise direction as influenced by a right offset or helical fletching. The time or distance it takes for this shift in direction to occur is unknown as it is based on the amount or degrees of right offset or helical in the fletchings. Such a shift in the arrow rotation can result in a loss of accuracy. Almost all "ready-made" or pre-fletched arrows that can be purchased in an archery shop or athletic store today are fletched with right offset fletching. Thus, the problem is pervasive in the field.

SUMMARY

The present invention generally relates to an archery bow string and cables, more specifically to an improved bow string designed to prevent elongation or creep of the string while improving accuracy of arrows cast from the bow. The improvement relates to the material used and the making of the bow string and cables Bow strings generally are made from a plurality of parallel fiber strands, the strands being bound together without compromising their parallel relationship. Conventional bow strings are made in multiple ways. The first conventional method includes: (1) Taking the individual fiber strands that are manufactured in a clockwise direction, (2) twisting the fiber strands together in a bundle around a center axis in a clockwise direction to entwine the at least one bundle into a completed string. This method will cast the arrow left or counterclockwise.

The second conventional method includes: (1) Using the individual fiber strands that are manufactured in a clockwise direction, (2) twisting the fiber strands together in a bundle around a center axis in a counterclockwise direction to entwine the at least one bundle into a completed string. This method will cast the arrow clockwise, however, the string and cables will have significantly more and continuous creep or elongation throughout the life of the string and cables.

The third conventional method includes: (1) manufacturing a string or cable with two bundles, (2) the first bundle would include taking individual fiber strands manufactured in a counter-clockwise direction and twisting them in a counter-clockwise direction (3) the second bundle would include taking individual fibers strands manufactured in a clockwise direction and twisting them in a clockwise direction, and (4) twisting the at least two bundles around center axis in a clockwise direction to entwine the at least two bundles into a completed string. This method will cause the arrow to cast to the left, and with one of the bundles being made with counterclockwise fiber strands that are twisted counterclockwise are then twisted clockwise to be bound together with the clockwise bundle, this can induce additional creep or elongation in the length of the string and cables.

One aspect of the present disclosure relates to an archery string comprising a string bundle twisted in the same direction as the fiber strand material. When the string bundle of the finished string or cable is twisted in the same direction as the manufactured fiber strand, the finished product is more stable, stronger and results in less creep. Thus, the end product maintains its desired length more consistently throughout the life of the string.

Accordingly, the present invention addresses the problems in the art created by the use of an individual fiber strands that are manufactured in a clockwise direction that are then used to create bundles that are twisted in a clockwise direction when making a bow string. The present invention further addresses the problems created by such clockwise twisted strings when used to propel an arrow fletched with a right "helical" or "offset" twist.

In some embodiments of the present invention, a string bundle is created containing multiple strands of counterclockwise twisted fiber material.

In some embodiments, more than one string bundles containing multiple counterclockwise twisted strands are created. The at least two bundles of strands are twisted around a center axis in a counterclockwise direction. The first and second bundles of strands may each be configured into a complete bow string.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate an exemplary embodiment and is part of the specification. Together with the present description, these drawings demonstrate and explain various principles of this disclosure. A further understanding of the nature and advantages of the present invention may be realized by reference to the following drawings. In the appended figures, similar components or features may have the same reference label.

DETAILED DESCRIPTION

Figure 1:
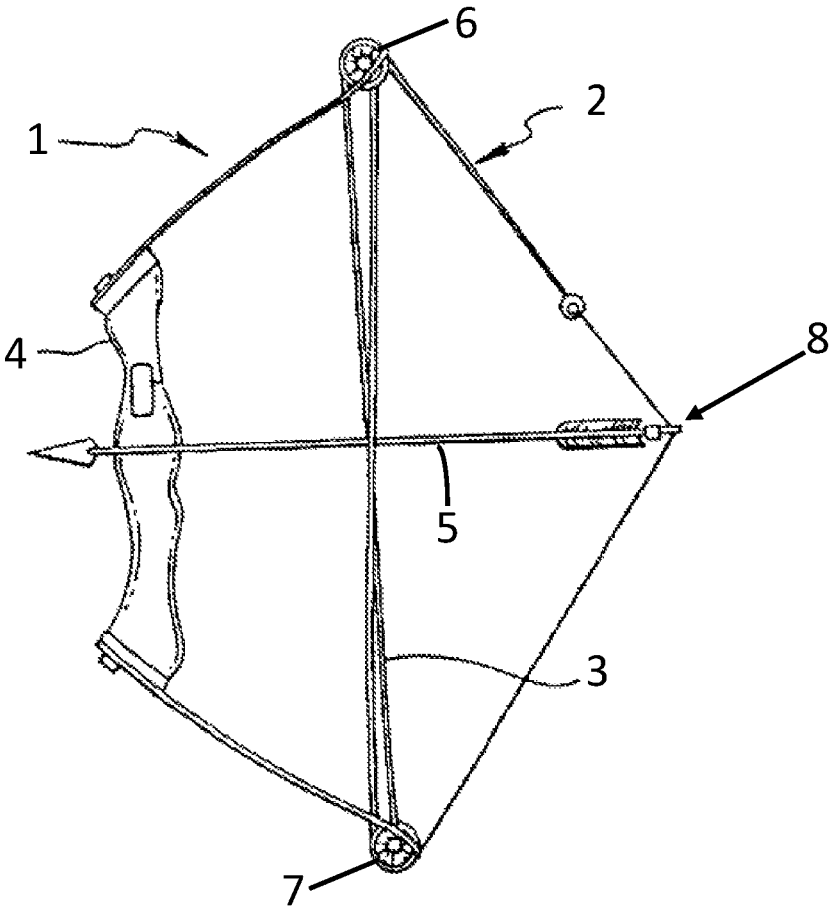
FIG. 1 is a side view of a conventional bow 1 with bow string 2, cable 3, riser 4, arrow 5, upper cam 6, lower cam 7, and arrow nocking point 8.

Many conventional string manufacturing processes use continuous, single-length strands. In these strings, the fibers are entwined into strands, and the strands are entwined and become a single helical rope or cord that is routed from one cam or limb of the bow or crossbow to the opposite cam or limb.

The traditional process for making bow strings uses a blended string fiber that is manufactured into a continuous piece of string and spun onto spools. A jig is used to lay up the string, the string is adjusted to an initial setup length that will produce the desired length once the string making procedure is finished. The initial loose end of the fiber from the spool is tied off to the jig, then the continuous string from the spool is wrapped around pegs on the jig until the desired number of strands needed for the string have been met, then the other loose end from the spool is tied off and cut loose from the spool. If a multi colored string is desired, then the number of strands would be divided between different colored spools; however the loose ends of each spool are tied off in a similar manner and often times the strands are laid up on the jig at the same time. Then the end loops (the very end of the finished string that would make a loop that would be placed on a peg on a cam or a limb tip) are served to secure the loose ends that were tied off and to bring the strands into a bundle. The bundle is then either put on a stretcher under load for a period of time or put on a machine that will give the bundle the desired number of twists per inch of string length. The machine also puts a desired amount of tension or load on the bundle, then spins the entire string so the end servings and center servings can be installed under load. Those of skill in the art may use variations of this traditional process to achieve a finished bow string.

As used herein, a "string" may refer to a cable used in a compound bow or a bowstring. A string may comprise a plurality of individual strands twisted together to form the string. Alternatively, the string may comprise at least two separate bundles of strands that each comprise about half of the total number of strands of a conventional bowstring or cable. Each of these separate bundles may be independently entwined relative to each other. Thus, each of the separate bundles may comprise individual fibers that are twisted together, and each of those individual fibers may be helically twisted only with other fibers in the same bundle.

The direction the string bundle is twisted will cause an arrow to cast or rotate a certain direction as it is propelled by the string during the shot. The result of a traditionally clockwise twisted fiber, stacked together in a clockwise twisted bundle will cause an arrow to cast counterclockwise or left, as it leaves the string when shot from a bow.

Those of skill in the art generally fletched their arrow shafts with either feathers or vanes having a right "helical" or "offset" twist direction in the fletchings. This creates a change in the direction of rotation in the arrow from the initiated launch direction of left or counter clockwise created by the clockwise twist in the string, to a right or clockwise direction as influenced by a right offset or helical fletching. The time or distance it takes for this shift in direction to occur is unknown as it is based on the amount or degrees of right offset or helical in the fletchings. Such a shift in the arrow rotation can result in a loss of accuracy.

Aspects of the present disclosure related to archery strings (bowstrings or cables) that may comprise a string created using multiple strands of counterclockwise twisted fiber material that is then twisted together in a counterclockwise direction. Such a counterclockwise twisted string will generate the preferred clockwise rotational direction in the arrow. Thus, combining the initial clockwise or right launch cast direction created by the counterclockwise twisted string, with the right offset or helical fletched arrow would result in increased accuracy.

Over times, the fibers within the bowstrings lose their integrity and strength resulting in an elongation of the strings overall length, also known as "creep," that hinders shooting performance. Additionally, the constant use of a bow string with high tensile loads and repeated load cycles tend to elongate the strings over time, thereby decreasing the stability, strength, and the overall length of the strings. Environmental conditions (e.g., temperature and humidity) can also increase the elongation of the strings. As a result, the accuracy and efficiency of the bow or crossbow can deteriorate over time.

Another aspect of the present disclosure relates to an archery string comprising a string bundle twisted in the same direction as the fiber strand material. When the string bundle of the finished string or cable is twisted in the same direction as the manufactured fiber strand, the finished product is more stable, stronger and results in less creep. Thus, the end product maintains its desired length more consistently throughout the life of the string The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Referring now to the figures in detail, FIG. 1 shows an archery bow 1 according to an embodiment of the present disclosure. In FIG. 1, the bow 1 is at a full-draw position. The bow 1 comprises a riser 4 from which upper limbs and lower limbs extend. The riser 4 may comprise a handle portion and other parts and accessories commonly known in the art.

The upper limbs may be connected to an upper cam 6, and the lower limbs may be connected to a lower cam 7. A bowstring 2 (i.e., draw string) may extend vertically across the length of the bow 1 between the upper cam 6 and the lower cam 7 when the bow 1 is positioned upright. The terminal ends of the bowstring may be attached to and held wound against the cams 6, 7, at least in the brace position, and the limbs may be flexed to retain tension in the bowstring 2. A cable 3 may also be attached to and extend between the upper cam 6 and the lower cam 7. Cable 3 may retain tension in the limbs and cams 6, 7 and may be controlled to adjust tension in the bowstring 2, draw length of the bowstring 2, and other tuning features of the bow 1.

The bow 1 shown in FIG. 1 is shown for example purposes to illustrate an archery device that may be used in conjunction with the principles and teachings of the present disclosure. Thus, while the bow 1 is a compound bow, it will be understood by those having ordinary skill in the art that the features of the bowstrings, cables, and related methods and apparatuses included in embodiments of the present disclosure may be applied to strings and related methods and apparatuses in traditional bows, recurve bows, crossbows, and other related archery equipment. Similarly, archery equipment applying the teachings of the present disclosure does not need to implement all of the features of the present disclosure.

When shooting an arrow 5, the tail end of the arrow 5 may be nocked with the bowstring 2 at a nocking point 8 while the bow 1 is in a rest position. The bowstring 2 may be drawn rearward to the full draw position, as shown in FIG. 1.

Figure 2:
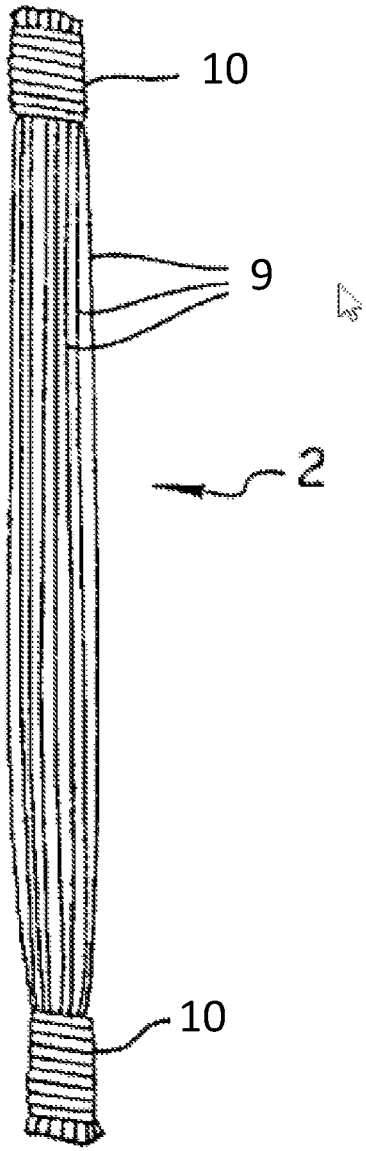
FIG. 2 is a sectional view of a conventional bow string 2 with a plurality of parallel strand fibers creating a bundle 9 and serving 10 around each end.
Figure 3:
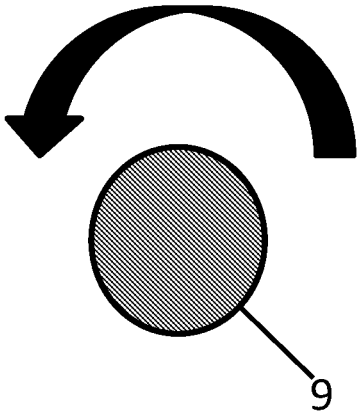
FIG. 3 is a detail view of an individual strand fiber 9 twisted in a counterclockwise direction.

The bow string 2 of the present invention is made up of a plurality of strands 9 as shown in FIG. 2. Prior art strands 9 are each twisted during manufacturing in a clockwise direction. As shown in FIG. 3, however, per the present invention, the individual strand 9 is twisted during manufacturing in a counterclockwise direction.

Figure 4:
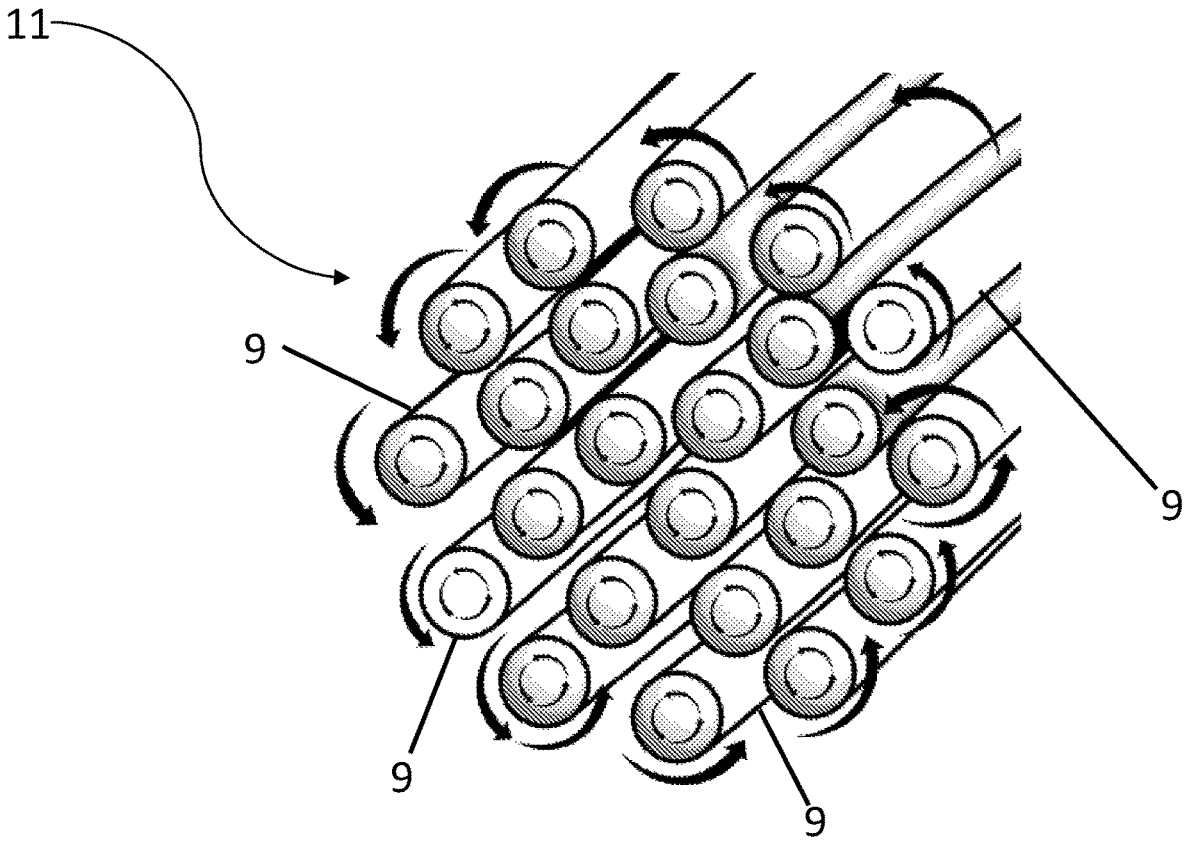
FIG. 4 is an end view of a section of a bowstring 1. The bowstring 2 is made of a plurality of strands 9. The strand fibers 9 are twisted in a counterclockwise direction as shown in FIG. 3 to bring the strand fibers 9 in contact with each other in order to form a bundle 11.
Figure 5:
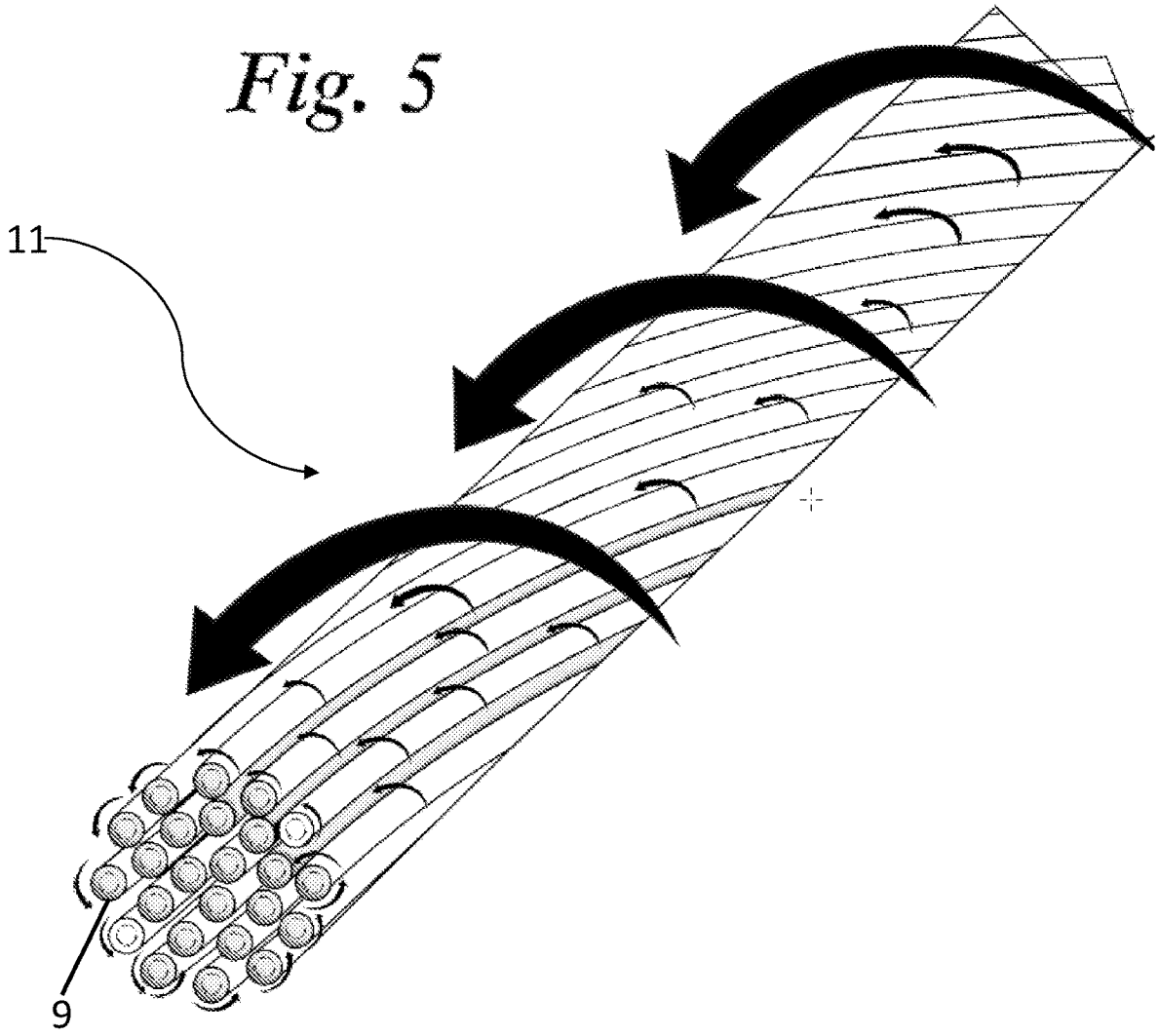
FIG. 5 is an extended view of a string bundle 11. The bundle 11 includes a plurality of strand fibers 9 that are twisted in a counterclockwise direction as shown in FIG. 3. Bundle 11 may be twisted in a counterclockwise direction as an individual bundle 11 or with more than one counterclockwise twisted bundle 11 to form a bowstring 2.

According to one embodiment of the invention shown in FIGS. 4 and 5, two or more of the counterclockwise twisted fiber strands 9 are then twisted together as a bundle 11 around a center axis in a counterclockwise direction to entwine the at least one bundle 11 into a completed string.

Figure 6:
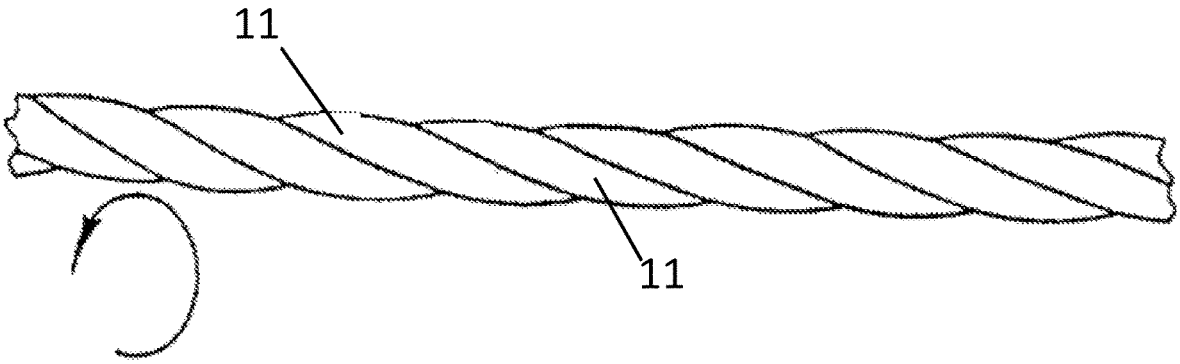
FIG. 6 is a side view of two bundles 11 twisted around a central axis in a counterclockwise direction.

According to another embodiment of the invention shown in FIG. 6, at least two separate bundles of fiber strands are created, where each comprise about half of the total number of strands of a conventional bowstring or cable. Each of these separate bundles may be independently entwined relative to each other. Thus, each of the separate bundles may comprise individual fibers that are twisted together, and each of those individual fibers may be helically twisted only with other fibers in the same bundle.

The use of different materials or colors does not alter the scope of the disclosure. Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

The invention claimed is:

1. An archery string, comprising: at least two strands of counterclockwise twisted fiber material that is twisted together in a counterclockwise direction.

2. The string of claim 1, wherein a string bundle is created containing multiple strands of counterclockwise twisted fiber material.

3. The string of claim 2, wherein the bundle is twisted in a counterclockwise direction.

4. The string of claim 2, wherein at least two or more counterclockwise twisted bundles are twisted in a counterclockwise direction.

5. The string of claim 2, wherein at least two or more bundles are twisted around a central axis in a counterclockwise direction.

6. A method of creating an archery string by twisting counterclockwise twisted fiber material together into bundles that are twisted together in a counterclockwise direction.

7. The method of claim 6, wherein strand fibers are twisted in a counterclockwise direction to bring the strand fibers in contact with each other in order to form a bundle.

8. The method of claim 6, wherein at least two or more counterclockwise twisted bundles are twisted in a counterclockwise direction.

9. The method of claim 6, wherein at least two or more bundles are twisted around a central axis in a counterclockwise direction.

* * * * *